US007485003B2

(12) United States Patent
Mandrusov et al.

(10) Patent No.: US 7,485,003 B2
(45) Date of Patent: Feb. 3, 2009

(54) ELECTROMAGNETIC INTERFERENCE CABLE BACKSHELL ASSEMBLY FOR HIGH-DENSITY INTERCONNECT

(75) Inventors: Val Mandrusov, Santa Clara, CA (US); Duane Friesen, Edmonton (CA)

(73) Assignee: Silicon Graphics, Inc., Sunnyvale, CA (US)

( * ) Notice: Subject to any disclaimer, the term of this patent is extended or adjusted under 35 U.S.C. 154(b) by 1178 days.

(21) Appl. No.: 10/235,221

(22) Filed: Sep. 5, 2002

(65) Prior Publication Data

US 2004/0048516 A1 Mar. 11, 2004

(51) Int. Cl.
*H01R 9/03* (2006.01)

(52) U.S. Cl. ..... 439/610; 439/247

(58) Field of Classification Search ..... 439/610, 439/247, 248, 358, 362, 246
See application file for complete search history.

(56) References Cited

U.S. PATENT DOCUMENTS

| | | | | | |
|---|---|---|---|---|---|
| 2,853,690 | A * | 9/1958 | Madison | 439/155 |
| 3,094,364 | A * | 6/1963 | Liagg | 439/247 |
| 3,111,355 | A * | 11/1963 | Samburoff et al. | 439/159 |
| 4,162,816 | A * | 7/1979 | Malsot | 439/246 |
| 4,548,455 | A * | 10/1985 | Ezure | 439/152 |
| 4,580,862 | A * | 4/1986 | Johnson | 439/248 |
| 4,684,192 | A * | 8/1987 | Long et al. | 439/374 |
| 4,789,351 | A * | 12/1988 | Fisher et al. | 439/248 |
| 5,092,774 | A * | 3/1992 | Milan | 439/66 |
| 5,411,415 | A | 5/1995 | Embo et al. | 439/610 |
| 5,647,758 | A * | 7/1997 | Ichikawa et al. | 439/362 |
| 5,752,845 | A * | 5/1998 | Fu | 439/247 |
| 5,820,412 | A * | 10/1998 | Koegel et al. | 439/610 |
| 6,017,245 | A * | 1/2000 | Karir | 439/610 |
| 6,062,872 | A * | 5/2000 | Strange et al. | 439/67 |
| 6,312,294 | B1 * | 11/2001 | Lai | 439/692 |
| 6,435,903 | B1 * | 8/2002 | Nelson | 439/528 |
| 6,527,572 | B2 * | 3/2003 | Jou | 439/248 |
| 6,588,937 | B2 * | 7/2003 | Imai et al. | 385/53 |
| 6,592,387 | B2 * | 7/2003 | Komenda et al. | 439/247 |
| 2002/0150345 | A1 * | 10/2002 | Imai et al. | 385/53 |

* cited by examiner

*Primary Examiner*—Hae Moon Hyeon
(74) *Attorney, Agent, or Firm*—Schwegman, Lundberg & Woessner, P.A.

(57) ABSTRACT

A cable connector assembly for high frequency applications having reduced electromagnetic emissions. Aspects include providing physical spacing and electrical isolation between the signal conductors and a conductive housing. An isolative member provides reduced capacitive coupling. One embodiment includes spring preloading of the electrical connector relative to the housing. One embodiment includes a connector floating longitudinally within a conductive housing.

20 Claims, 10 Drawing Sheets

ELECTROMAGNETIC INTERFERENCE CABLE BACKSHELL ASSEMBLY FOR HIGH-DENSITY INTERCONNECT

RELATED APPLICATIONS

This document is related to U.S. patent application Ser. No. 09/730,077, filed Dec. 5, 2000, and U.S. patent application Ser. No. 10/205,877, filed Jul. 24, 2002, each of which are incorporated herein by reference.

TECHNICAL FIELD OF THE INVENTION

The present invention relates generally to the field of electrical interconnects, and, in particular, to an electromagnetic interference (EMI) cable backshell assembly suitable for applications prone to high levels of radiated electromagnetic emissions.

BACKGROUND

Electromagnetic interference affects the performance of electrical circuits. Reduction of sensitivity to EMI, as well as the reduction of radiated levels of EMI, is an important consideration in the design of electrical circuits and devices. With increasing power levels and frequency, radiated emissions also rises. Conversely, circuits operating with reduced power levels are particularly sensitive to undesirable radiation.

Designers often rely on gaskets and other shielding measures to reduce EMI radiated emissions. An area of particular interest concerns EMI emission suppression for high density interconnects. Density refers to the number of electrical connections in a given area of a connector. A typical high density connector has 100 pins in the space having dimensions of approximately 38 mm by 10 mm, or an area of 3.8 $cm^2$. An example of an application calling for such a connector is the High Performance Parallel Interface-6400 (HIPPI-6400) protocol. HIPPI-6400 relates to high frequency, digital data transmissions at 6400 Mbit/s of data per direction.

Two types of emissions are common to electronic systems: common mode (CM) and differential mode (DM). Common mode emissions are referenced to earth ground and can be caused by current on the outer surface of a shielded component. This current can be caused by capacitive coupling between the internal current carrying components (signal connector pins, traces or wires) and the shielding components (cable shield or backshells). Because of poor bonding between the different parts of the shielding system or inadequate thickness of the shielding, this current may find its way to the outer surface of the shield and can cause radiated emissions. This radiation can result in failure of a system or component to meet applicable EMI compliance standards.

For the reasons stated above, and for other reasons stated below which will become apparent to those skilled in the art upon reading and understanding the present specification, there is a need in the art for a connector assembly to address the problem of undesirable EMI emissions without adversely effecting the electrical connection.

SUMMARY

The above mentioned problems associated with connector assemblies for applications prone to interference from high levels of radiated electromagnetic emissions, and other problems, are addressed by the present invention and will be understood by reading and studying the following specification.

The present subject matter allows for separate movement of the electrical conductors and the shielding components thereby allowing each to be adjusted for desired performance. The signal carrying components are permitted to float relative to the shielding or housing.

In particular, an illustrative embodiment of the present invention includes a connector comprising an electrical connector, a connector shell encasing the electrical connector, a connector housing, and a plurality of clamping screws. The connector housing, in one embodiment, is electrically conductive. The connector shell, in one embodiment, provides physical separation and is fabricated of an insulative material. The electrical connector has a cable end and a coupling end wherein the cable end is adapted for receiving conductors of a cable and the coupling end is adapted for mating with a matching connector. The connector shell surrounds the electrical connector between the cable end and the coupling end. The connector housing is adapted to receive the connector shell and includes a nose end and a cable orifice wherein the nose end is proximate to the coupling end and the cable orifice is proximate to the cable end. In one embodiment, the connector housing includes a bottom and a lid. The clamping screws engage the connector housing directly or indirectly and are threadably coupled with associated threaded fasteners of the matching connector.

In one embodiment, the present subject matter includes an electrical connector, a plastic insulative separation shell, a housing with lid, two clamping screws, two springs and two cable sealing members.

The electrical connector includes sides, a mating end and a cable end. The mating end is adapted to mate with a matching connector in an electric circuit housing. The cable end is adapted to receive the electrical conductors of a cable.

In one embodiment, the plastic insulative separation shell substantially surrounds the sides of the electrical connector to provide a controlled separation between the shell and the housing. The shell is adapted to fit inside the housing but adapted to move independent of the housing along a longitudinal axis of the housing. In one embodiment, the shell is adapted to move independently along an axis parallel with the direction of engagement for the conductors of the connector.

In one embodiment, the housing has a longitudinal axis and includes a mating face near a first end of the axis, a cable orifice near a second end of the axis, two side walls aligned substantially parallel to the longitudinal axis, a bottom and a lid defining an interior of the housing. The mating end is proximate the mating face and the cable end is proximate the cable orifice. The housing includes a way for receiving the electrical connector captive in the insulative separation shell and is adapted for permitting relative but independent movement of the insulative separation shell and the housing along the longitudinal axis. The housing includes a clamping surface having a fixed position relative to the mating face. The housing includes two bores aligned substantially parallel with the longitudinal axis and proximate each side wall. The bores are adapted to receive the clamping screws. Proximate the middle of the bores are clamping surfaces adapted to receive springs on one side and the shoulder of the clamping screws on the other. The connector housing clamping surface is adapted for exerting pressure on the springs. In one embodiment, the connector housing clamping surface is an integral part of the connector housing and when the connector housing exerts a force on the connector housing mating surface, the connector housing mating surface is urged against a flat surface of the electric circuit housing. An EMI gasket is compressed between the connector housing mating surface and the flat surface of the electric circuit housing.

The connector housing is further adapted to retain two cable sealing members proximate the cable orifice end of the housing. An outer cable sealing member is located proximate the cable and an inner cable sealing member is located proximate the electrical connector. In one embodiment, the connector housing includes cable saddle clamps proximate the two cable sealing members. The housing is electrically conductive. In one embodiment, an outer saddle clamp provides strain relief and mechanical strength to hold the isolative jacket of the cable and an inner saddle clamp provides an electrical bond between the cable braid, or shield, and the backshell assembly.

The clamping screws each have a thread portion, a shoulder and a head. The clamping screws pass through bores in the housing wherein the thread portion is proximate the mating face and the head is proximate the cable orifice. The shoulders of are disposed proximate to the middle of each clamping screw and are adapted to exert a pressure on the housing clamping surface. The springs are adapted to exert an opposing force between the clamping surface and the insulative separation shell, urging the electrical connector in the direction of the mating face.

In one embodiment, the present subject matter permits travel of the connector beyond the mating face to facilitate ease of engagement of the electrical connector prior to engagement of the threads of the clamping screws. Engagement the electrical connector can be made prior to engaging the threads of the clamping screws. Engagement of the clamping screws with threaded standoffs associated with the matching connector causes the mating face to be drawn towards the electrical circuit housing and compression of the springs applies additional force to urge the electrical connector to engage the matching connector.

The two sealing members are adapted to exert opposing pressure between themselves along with the housing cable saddles and the cable shield and jacket. When the lid is installed on the housing, the lid exerts a force on the sealing members urging the sealing members towards the housing saddles. This force on the inner sealing member compresses the cable shield between the inner sealing member and the adjacent saddle, thus providing a low impedance bond between the cable shield and the housing. Also, when the lid is installed on the housing, the force on the outer sealing member compresses the cable jacket between the outer sealing member and the adjacent saddle, thus providing strain relief for the cable. The sealing members and the lid are electrically conductive.

In one embodiment, the present subject matter includes a connector assembly having an electrical connector, a plastic insulative separation shell, an extruded metal housing, a cable sealing plate with an EMI gasket, two clamping screws with retaining standoffs and two springs.

In one embodiment, the electrical connector includes sides, a mating end and a cable end. The mating end is adapted to mate with a matching connector in an electric circuit housing. The cable end is adapted to receive the electrical conductors of a cable.

In one embodiment, the plastic insulative separation shell substantially surrounds the sides of the electrical connector to provide a separation between the electrical connector and the housing. The electrical connector, along with the separation shell, is adapted to fit inside the housing and adapted to move independent of the housing along the longitudinal axis of the housing. In one embodiment, the separation shell is stationary with respect to the housing and the connector moves independently along an axis within the separation shell. In one embodiment, the separation shell is rigidly coupled to the connector and the separation shell and connector move independently along an axis within the housing.

One embodiment includes an electric circuit housing mating face near a first end of a longitudinal axis of the housing and a cable sealing plate mating face near a second end of the longitudinal axis. In one embodiment, the housing includes a rectangular-shaped extruded metal part having an interior cavity. The electric circuit housing mating end is disposed proximate the electric circuit housing and the cable sealing plate mating face is disposed proximate the cable. The housing includes a way, or channel, for receiving the electrical connector and is adapted for permitting relative but independent movement of the electrical connector and the housing along the longitudinal axis. The housing includes a way for receiving the cable sealing plate and is adapted to hold the cable sealing plate captive and provide an EMI seal around the periphery of the cable sealing plate. The housing is electrically conductive. In one embodiment, two or more cable sealing plates are disposed near the cable end of the housing.

In one embodiment, the cable sealing plate includes a first portion and a second portion, and provides a clamping surface having a fixed position relative to the electric circuit housing mating face. The first portion and second portion of the cable sealing plate is captivated by the housing. In one embodiment, the cable sealing plate is engaged by structure on the interior of the housing. The cable sealing plate includes a cable saddle and a plurality of clearance holes. The clearance holes are adapted to receive clamping screws to secure the housing to the electric circuit housing mating face. In one embodiment, both the first portion and the second portion include clearance holes and a semicircular opening. The semicircular opening provides a cable saddle in the center of the cable sealing plate. In one embodiment, the clearance holes are adapted to receive the clamping screws and provide clamping surfaces. The clamping surfaces, disposed proximate the cable end, are adapted to engage the shoulders of the clamping screws. When the clamping screws are engaged in threaded standoffs on the electric circuit housing mating face, the shoulder of the clamping screws exerts a force on the outer surface of the clamping surfaces. In addition, the inner surface of the cable sealing plate buttresses one end of one or more connector springs. The screw shoulder, when tightened, forces the connector shell face against the mating surface. The spring, or springs, are compressed as the electrical connector is mated. In one embodiment, the connector springs urge the connector in a direction away from the cable end of the connector housing. In one embodiment, the cable sealing plate is connected rigidly to the housing, thus, the force exerted by the shoulders of the clamping screws exerts a force directly on the housing mating surface, urging the connecter housing against a flat electric circuit housing surface. In one embodiment, a connector EMI gasket is compressed between the housing face and the electric circuit housing mating face. In one embodiment, the cable sealing plate buttresses the clamping springs on one side and the shoulder of the clamping screws on the other side. The clamping spring is compressed as the electrical connector is mated.

The cable saddle is adapted to retain a cable EMI gasket disposed proximate to the cable. In one embodiment, the width of the cable EMI gasket is less than the width of the saddle. In one embodiment, the width of the cable EMI gasket is greater than the width of the saddle. The width of the cable saddle and the cable saddle gasket is selected to increase the bonding surface of the interconnect. An increased surface area (wider saddle and saddle gasket) provides increased conductivity between an external backshell and the faceplate. An insulative jacket of the cable is adapted such that the cable shield contacts the cable EMI gasket. The cable EMI gasket is in contact with the saddle and the saddle contacts the housing. A mechanical fastener is used to apply pressure between the cable sealing plate and the insulative jacket of the cable to provide a mechanical strain relief for the cable. The gasket is wrapped around the cable and the cable sealing plate is inserted in the housing, a force is exerted between the plate (and housing) and the cable shield, thus compressing the gasket and forming a low impedance bond between the plate (and housing) and the cable shield. The cable sealing plate is electrically conductive.

The clamping screws each have a thread portion, a shoulder and a head. The clamping screws pass through bores in the housing and the thread portion is proximate the mating face of the connector housing and the head and shoulder are proximate the cable sealing plate. The shoulders are adapted for exerting pressure on the clamping surface of the cable sealing plate. The springs are adapted to exert an opposing force between the clamping surface and the insulative separation shell, urging the electrical connector in the direction of the mating face.

In one embodiment, the connector housing is adapted to permit the electrical connector to travel beyond the mating face of the connector housing. Travel beyond the mating face of the connector housing, in one embodiment, facilitates alignment and mating of the electrical connector with the matching connector prior to engagement of the clamping screws with threaded fasteners associated with the matching connector. Engagement of the clamping screws with threaded standoffs, or other fasteners, associated with the matching connector causes the mating face to be drawn towards the electrical circuit housing. As the connector housing is drawn towards the matching connector by action of the clamping screw threads, the connector springs are compressed and an increasing force is applied to urge the electrical connector towards the matching connector.

In one embodiment, the insulative separation shell is rigidly captivated by the electrically conductive housing. The electrically conductive housing includes a way aligned substantially on an axis defined by the nose end and the cable orifice wherein the insulative separation shell couples with the way. In one embodiment, the electrical connector and housing are adapted to prevent independent movement of one with respect to the other.

In one embodiment, reduction of EMI radiation involves reducing the energy coupled to the shield by increasing the physical separation between the current carrying signal components in a high density connector and their shielding component. In one embodiment, the shielding component includes a metallic housing of a backshell connector. The reduction of EMI emissions is proportional to the increase in the current carrying components separation. This reduction is also related to the material used to provide the separation. In one embodiment, air is used as the separation medium because of its low dielectric constant. In one embodiment, a synthetic material is selected as the separation medium.

In use, each conductor of the connector for the cable assembly is to be mated with the corresponding conductor of the electrical device. In addition, and at the same time, a low impedance bond is established between the shielding components of the cable assembly and the electric device shielding components to reduce EMI radiation. The electrical device shielding components, or chassis, may include a structure fabricated of electrically conductive material. The low impedance bond is sometimes established by compressing a conductive gasket between the shielding surface of the cable assembly connector and the shielding surface of the electrical device connector.

DETAILED DESCRIPTION

The following detailed description refers to the accompanying drawings which form a part of the specification. The drawings show, and the detailed description describes, by way of illustration specific illustrative embodiments in which the invention may be practiced. These embodiments are described in sufficient detail to enable those skilled in the art to practice the invention. Other embodiments may be used and mechanical and electrical changes may be made without departing from the scope of the present invention. The following detailed description is, therefore, not to be taken in a limiting sense. Like reference numbers refer to similar items in all the figures.

The backshell assembly includes a connector, a cable end, and a housing in which the connector is encased. The connector of the backshell assembly mates with a matching connector affixed to an electronic circuit housing, circuit board or chassis. As used herein, references to the forward direction are understood to mean in a direction towards the matching connector. Consequently, to engage the electrical connector, the backshell assembly is moved in the forward direction. The rearward direction is understood to denote in a direction away from the matching connector. Consequently, to disengage the electrical connector, the backshell assembly is moved in the rearward direction.

In one embodiment, an exemplary connector is marketed under the trademark MICROPAX®. MICROPAX® is a registered trademark of Berg Technology, Inc., One East First Street, Reno, Nev. 89501. The MICROPAX® connector includes a conductive shell and paddleboards for making connection to a cable as well as a matching connecter. One embodiment of the MICROPAX® connector meets the standards of HIPPI-6400. Other connectors, shells or components may also be utilized in the present system. The present system is suited for applications wherein EMI is possible. One typical application entails a high frequency connector having high density. It is understood, however, that the present system is not so limited, and may be used, for example, with low density connectors and in applications where EMI radiation is not a significant concern.

Figure 1A:
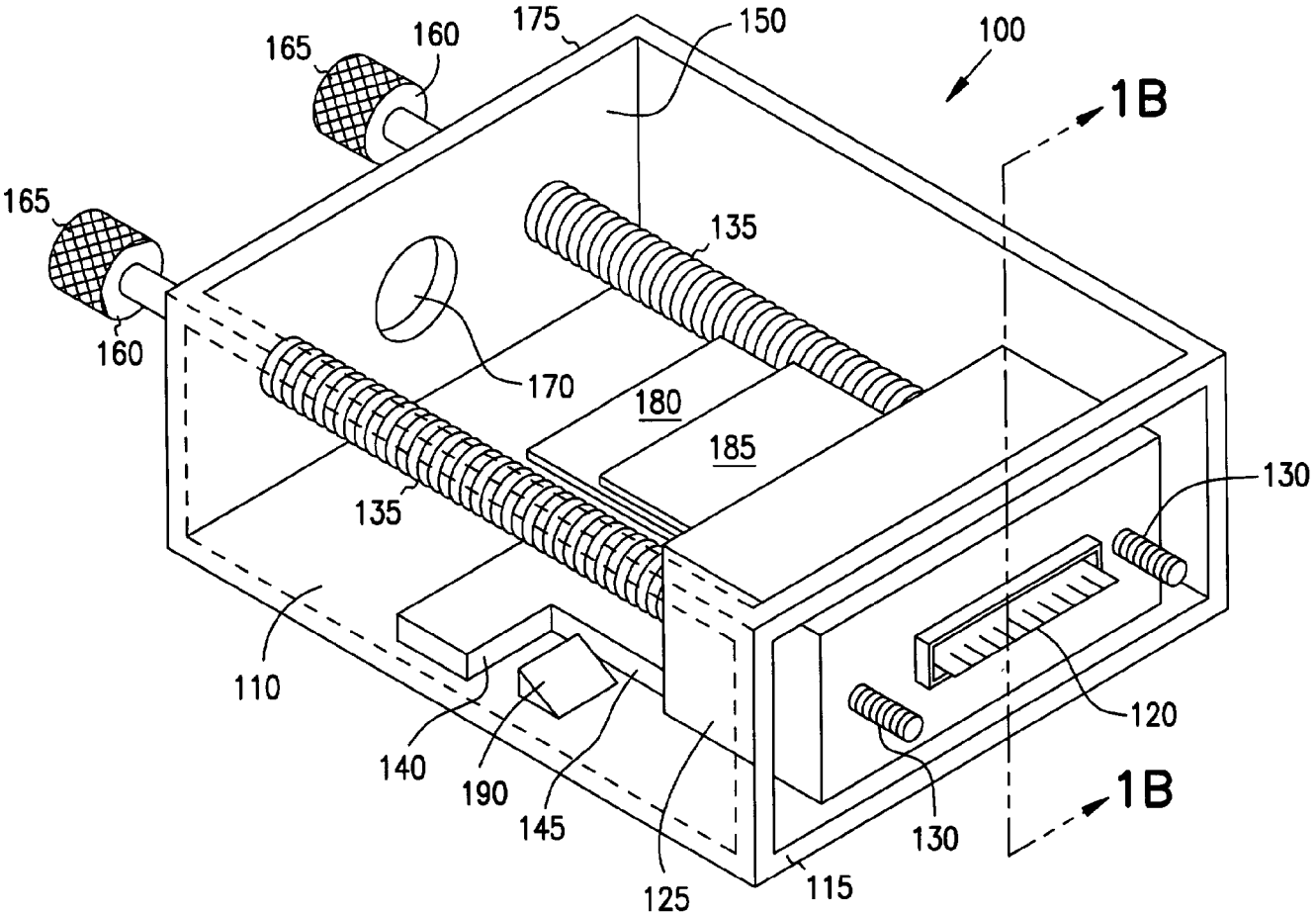
FIG. 1A illustrates an isometric view of one embodiment of the present system.

FIG. 1A depicts one embodiment of the present subject matter, backshell assembly 100, with the lid removed. Backshell assembly 100 includes housing 110. In one embodiment, housing 110 is fabricated of electrically conductive material, such as aluminum. In one embodiment, housing 110 is fabricated of insulative material having a conductive layer, in which case, the conductive layer may be internal, external or elsewhere relative to housing 110. Housing 110 has mating face 115 adapted for mating with a chassis, conductive circuit housing, or a conductive circuit housing with a conductive gasket. Housing 110 also has a back wall, the interior surface of which is designated as item 150 in FIG. 1, and the exterior surface of which is designated as item 175 in FIG. 1.

In one embodiment, assembly 100 also includes electrical connector 120. Electrical connector 120 may include a high density connector shell, such as a MICROPAX® connector. Connector 120 has forward end that mates with a matching connector assembly. Connector 120 also has a rearward, or cable, end. In one embodiment, the cable end of connector 120 accepts two paddleboards, 180 and 185. Paddleboards 180 and 185 are adapted for connecting to electrical conductors of a cable. For sake of clarity, the cable is not shown in the drawing. The cable may include multiple copper, aluminum, or other conductors. The cable may be soldered to paddleboards 180 and 185. The cable enters the backshell assembly via cable orifice 170, shown here in the back wall of the housing. The cable may enter the backshell assembly on another wall of the assembly.

In one embodiment, connector 120 is encircled with shell holder 125. Shell holder 125 is fabricated of insulative material. In one embodiment, shell holder 125 includes a polymer or plastic. In one embodiment, shell holder 125 is fabricated of DELRIN® or TEFLON®, both registered trademarks of E.I. DU PONT DE NEMOURS AND COMPANY, 1007 Market St., Wilmington, Del. Connector 120 is received in a cavity of shell holder 125 and, in one embodiment, paddleboards 180 and 185 extend in a direction opposite that of mating face 115. Paddleboards 180 and 185 provide a ground connection to maintain signal integrity pursuant to the standards of the HIPPI-6400 specification. Shell holder 125 provides physical spacing between the signal conductors of the cable and the connector relative to housing 110 sufficient to attenuate EMI radiation through housing 110. Shell holder 125 also provides electrical isolation between the signal conductors and the housing to meet EMI standards for HIPPI-6400 connector assemblies. In one embodiment, capacitance between the signal conductors and the housing is a function of the material selected and the thickness of shell holder 125. Shell holder 125, in one embodiment, is fabricated of material having dielectric properties that reduces capacitive coupling.

In one embodiment, shell holder 125 is coupled securely to shell holder base 145. In one embodiment, base 145 is in slidable contact with the interior surface of the bottom of housing 110. Base 145 is shaped to fit within the bottom of housing 110 and allow shell holder 125 to slide linearly within housing 110. In one embodiment, base 145 includes an ear 140 on each side. Each ear 140 is in contact with an interior side wall of housing 110. In one embodiment, mechanical stops provide limits to the forward and rearward movement of shell holder 125 within housing 110. In one embodiment, the rearward limit is established by the compressed length of spring 135. In one embodiment, the forward movement of shell holder 125 is limited by stop 190 securely attached to housing 110. In one embodiment, the forward movement of shell holder 125 is limited by the spring in the relaxed position. In one embodiment, the forward and rearward limits of shell holder 125 are established by a slot in shell holder base 145. A pin, stud, or screw engaging the slot prevents movement of shell holder 125 beyond the forward and rearward limits. In one embodiment, stop 190 provides a mechanical limit to the forward travel of shell holder 125. In one embodiment, shell holder 125 travels on a longitudinal axis of housing 110 in a way. The way may include formed linear sections of housing 110 which are engaged by complementary elements of shell holder 125. In another embodiment, shell holder 125 is captivated by, and moves in, ways formed by structure within housing 110. Such structure may include the springs 135, clamping screws, or jackscrews, 230, the interior sidewalls of housing 110, or any other such structure.

In one embodiment, a pair of jackscrews extend forward alongside connector 120. Each jackscrew has a thread end 130, a head 165, and a shoulder 160 positioned between thread end 130 and head 165. In one embodiment, shoulder 160 is the underside of head 165. In one embodiment, shoulder 165 is a larger diameter portion adjacent to a smaller diameter portion. The threads on thread end 130 correspond with threads on a standoff associated with a matching connector coupled to an electronic circuit housing.

Proper mating of connector 120 with a matching connector entails establishing electrical connection as well as engaging the threads of the jackscrew with the threaded standoff.

In one embodiment, the jackscrews pass through the interior of housing 110. In one embodiment, the jackscrews are external to housing 110. In one embodiment, the jackscrews pass through the back wall of housing 110.

Springs 135 provide a force urging shell holder 125 in the forward direction. In one embodiment, spring 135 is a wound tension spring threaded on a jackscrew. In one embodiment, spring 135 is captivated by structural elements within housing 110. Structural elements may include counterbores, studs, raised portions or other means of captivating spring 135. In one embodiment, two jackscrews and two springs are depicted. The present system may include a single jackscrew or more than two jackscrews. In various embodiments, the present system includes a single spring or more than two springs. Preloading of spring 135 urges connector 120 forward and provides a low impedance connection with the matching connector.

In one embodiment, rearward movement of the shell holder 125 is limited by a threaded fastener engaging the threads of the jackscrew. For example, in an embodiment having two jackscrews, a threaded nut on each jackscrew may be used to captivate, and restrict the movement of, shell holder 125. Other means of limiting the rearward movement of shell holder 125 are also contemplated.

Figure 1B:
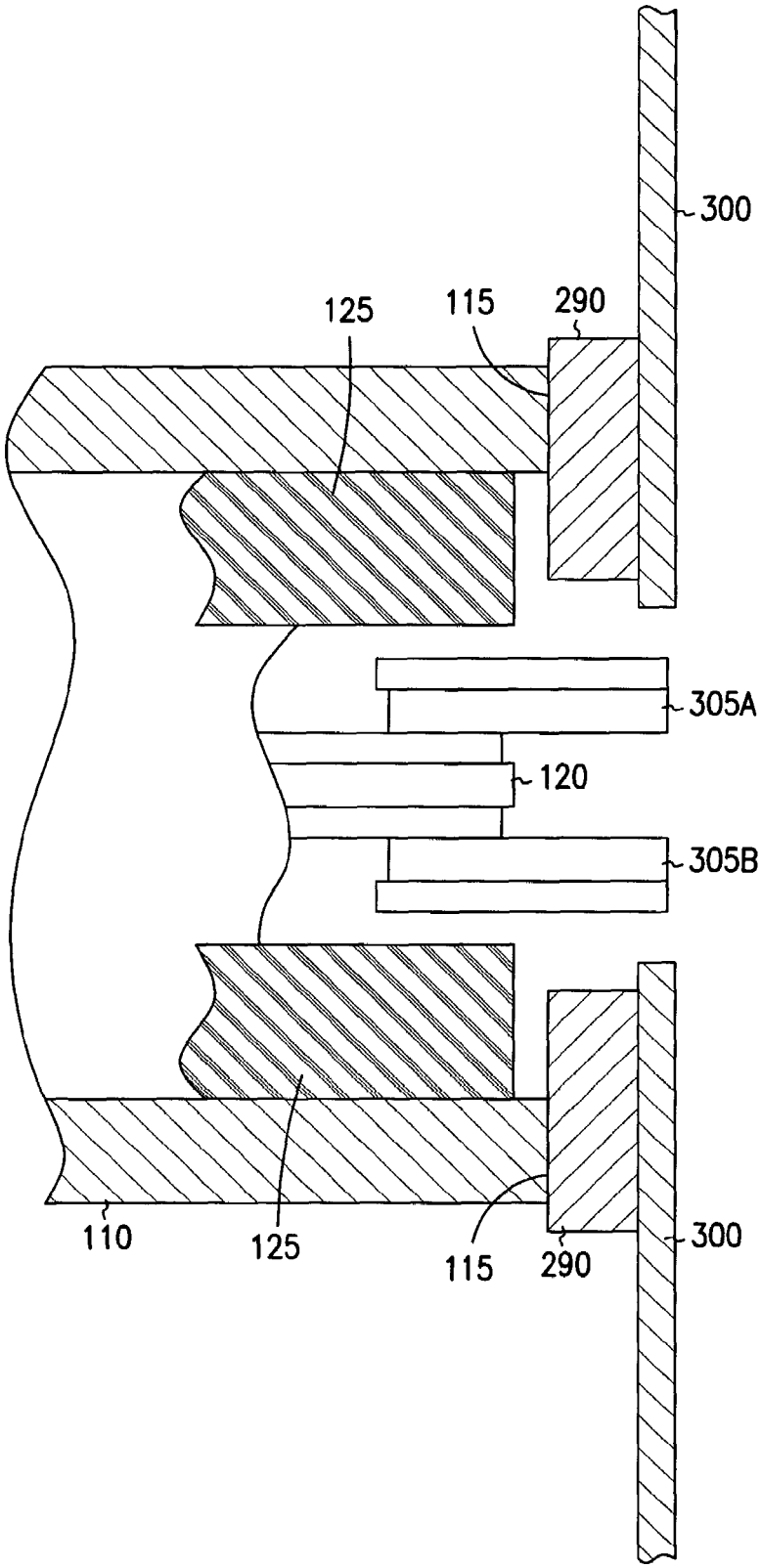
FIG. 1B illustrates a view of the present system when assembled to a matching connector.

FIG. 1B depicts a view of the present system when mated to a matching MICROPAX® connector. The matching connector is represented by items 305A and 305B, shown herein associated with electrical housing 300. Housing 300 is electrically conductive. Gasket 290 is positioned between mating face 115 of connector housing 110 and housing 300. Gasket 290 includes a center opening to allow coupling of connector 120 with matching connectors 305A and 305B. Gasket 290 attenuates EMI radiation and provides a low impedance electrical connection between housing 110 and housing 300. In the figure, insulative shell holder 125 is encased by electrically conductive housing 110. As shown, connector 120 mates with matching connectors 305A and 305B.

In one embodiment, proper assembly of the connector 120 to matching connector 305A and 305B includes engagement of a jackscrew (not visible in the figure). Gasket 290 is compressed by the force exerted by the jackscrew. Compression of gasket 290 reduces the impedance between face 115 and housing 300. Compression also increases EMI attenuation at the interface of face 115 and housing 300.

Figure 2:
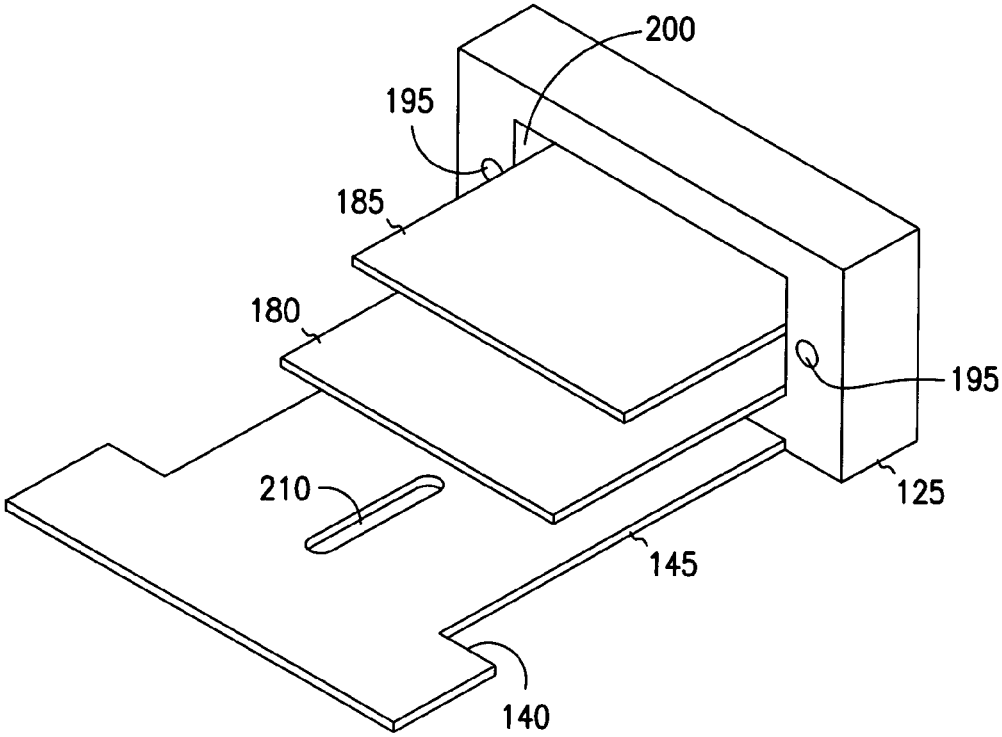
FIG. 2 illustrates an isometric view of a portion of one embodiment of the present system.

FIG. 2 depicts an isometric view of a portion of one embodiment of the present system. In one embodiment, shell holder 125 is affixed to shell holder base 145. Shell holder 125 includes holes 195 on either side of paddleboards 180 and 185. Hole 195 receives a jackscrew. In addition, a spring (not shown in this figure) exerts a force on the rearward face of shell holder 125.

Paddleboards 180 and 185 receive conductors of the cable and provide an interface with connector 120. Paddleboard 185 is shown herein as having a length less than paddleboard 180, however the present system is not so limited and the relative lengths can be otherwise. In one embodiment, the cable includes copper conductors, each of which is bonded to conductors of paddleboard 180 or 185. In one embodiment, bonding includes soldering conductors to the connector.

Cavity 200 receives paddleboards 180 and 185 and connector 120. Cavity 200 is shown herein as a rectangular hole in shell holder 125, however, other configurations are also contemplated.

As noted above, shell holder 125 is fabricated of insulative material. In one embodiment, shell holder 125 is fabricated of a material selected for having properties that reduces capacitive coupling between the connector and the backshell housing. The thickness and material of the shell holder, or insulative separator, determines the capacitive coupling between the external housing and the signal carrying components. Reduced capacitive coupling between the backshell and the internal signal carrying components yields reduced EMI.

Base 145 includes ears 140. Ears 140 maintain alignment of shell holder 125 within housing 110. Shell holder base 145 also is shown herein having slot 210 aligned substantially parallel with the direction of movement of shell holder 125. Slot 210 maintains alignment of shell holder 125 and provides mechanical limits to the travel of shell holder 125.

Figure 3:
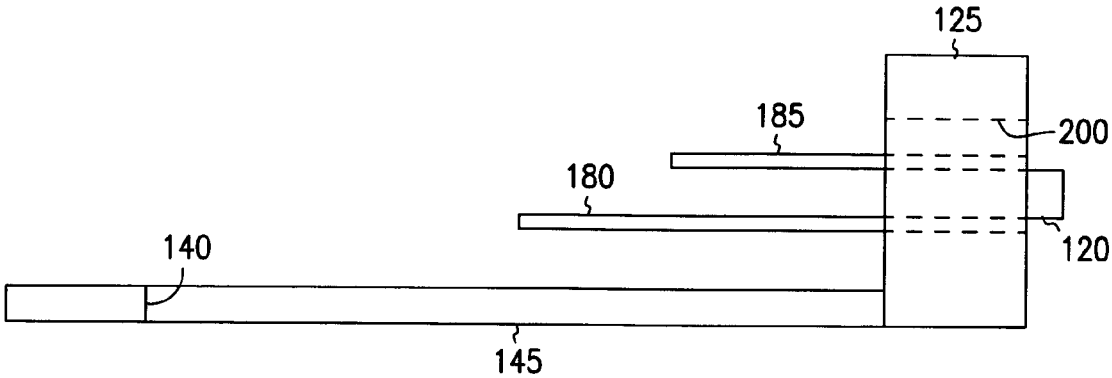
FIG. 3 illustrates a side view of the portion shown in FIG. 2.

FIG. 3 depicts another view of one embodiment of connector 120, shell holder 125, paddleboard 180, paddleboard 185, and shell holder base 145. The boundaries of cavity 200 are visible as a hidden line within shell holder 125. Ear 140 appears on the rearward portion of base 145. In one embodiment, paddleboards 180 and 185 extend forward through shell holder 125 and are integral with connector 120.

Figure 4:
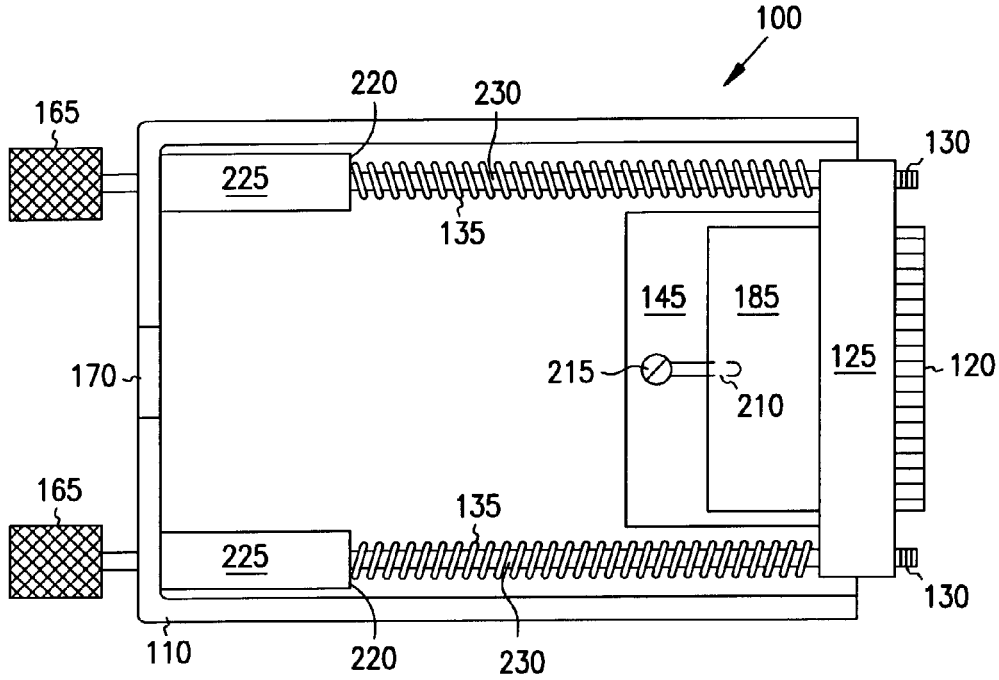
FIG. 4 illustrates a top view of one embodiment of the present system.

FIG. 4 depicts a view of another embodiment of present system 100. In one embodiment, electrically conductive housing 110 provides a housing for connector 120 and various associated components. An electrical cable enters the housing at orifice 170 and terminates at the connector 120. Electrical connection to the connector 120, in one embodiment, is established by means of a pair of paddleboards. Paddleboard 185 is visible in the figure and a second paddleboard is obscured by the first. Shell holder base 145 is coupled to shell holder 125 (with connector 120) and moves fore and aft as limited by slot 210 and screw 215. Spring 135 exerts a forward force on shell holder 125. A first end of spring 135 is in contact with shell holder 125 and a second end of spring 135 is in contact with standoff 225. Standoff 225 is in contact with an interior wall of housing 110 and spring 135 at face 220. Spring 135, and standoff 225 are concentrically aligned with jackscrew 230. Jackscrew 230 includes head 165 for manual manipulation of jackscrew 230. Head 165 also contacts housing 110 and exerts a clamping force to secure face 115 of housing 110 to an electrical housing associated with a matching connector.

Figure 5:
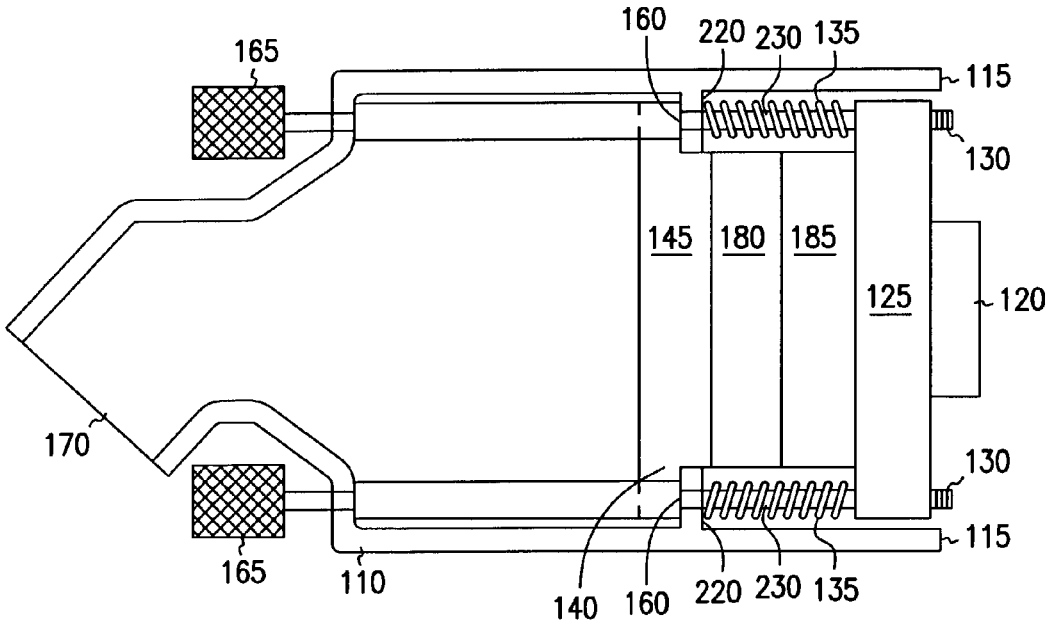
FIG. 5 illustrates a top view of one embodiment of the present system.

FIG. 5 illustrates another embodiment of the present system. Housing 110 includes mating face 115 at a forward end and cable orifice 170 at a rearward end. Connector shell 120 extends forward of shell holder 125. Electrical connections to electrical connector 120 are via paddleboard 185 and paddleboard 180. Shell holder base 145 extends rearward from shell holder 125 into housing 110. Base 145, in one embodiment, includes ears 140 that slidably engage structure 220 of housing 110 to limit the forward movement of shell holder 125 and connector 120. Ears 140 also help maintain alignment of shell holder 125 in housing 110.

Spring 135 is held captive on the shaft of jackscrew 230 and exerts an opposing force on shell holder 125 and housing structure 220. Engagement of thread end 130 of jackscrew 230 results in a clamping force applied to housing 110 at shoulder 160. Face 115 is forced against the gasket 290 by jackscrew 230.

In one embodiment, as shown in FIG. 5, the cable exits housing 110 at an angle relative to the longitudinal axis. The longitudinal axis is parallel with the direction of travel of connector 120. In other embodiments, the cable exits the housing at an angle substantially parallel with the longitudinal axis.

Figure 6B:
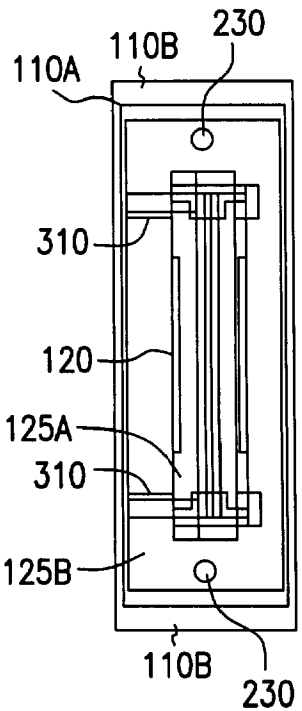
FIGS. 6A and 6B illustrate a top view and an end view, respectively, of one embodiment of the present system.
Figure 6A:
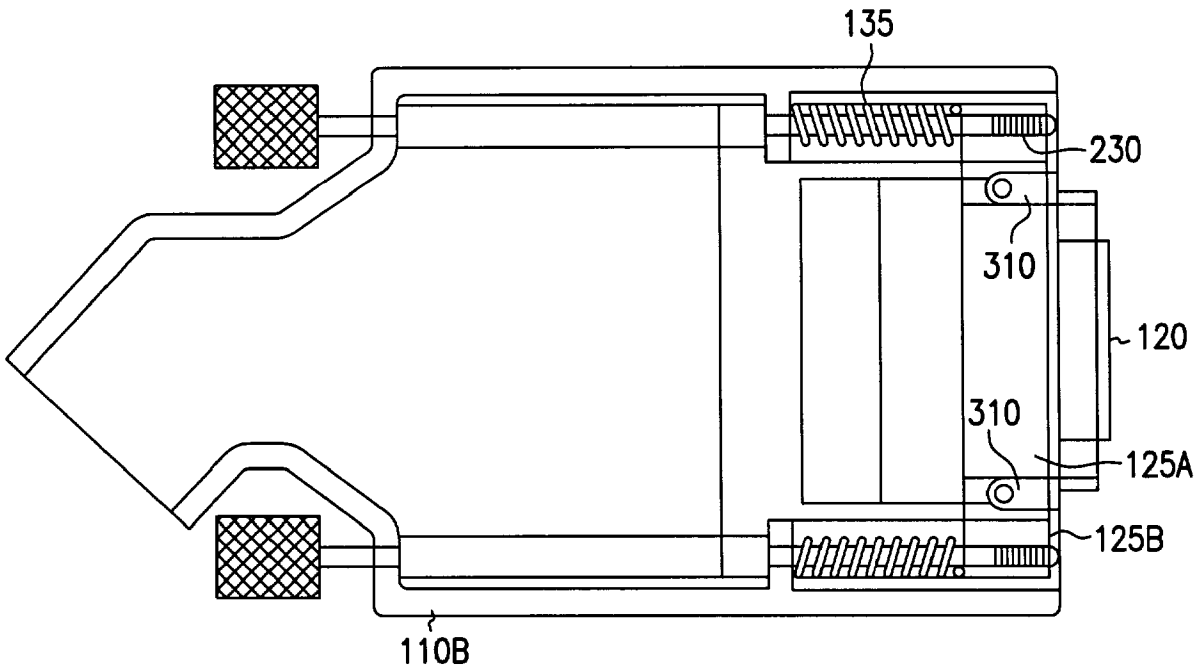
Figure 6C:
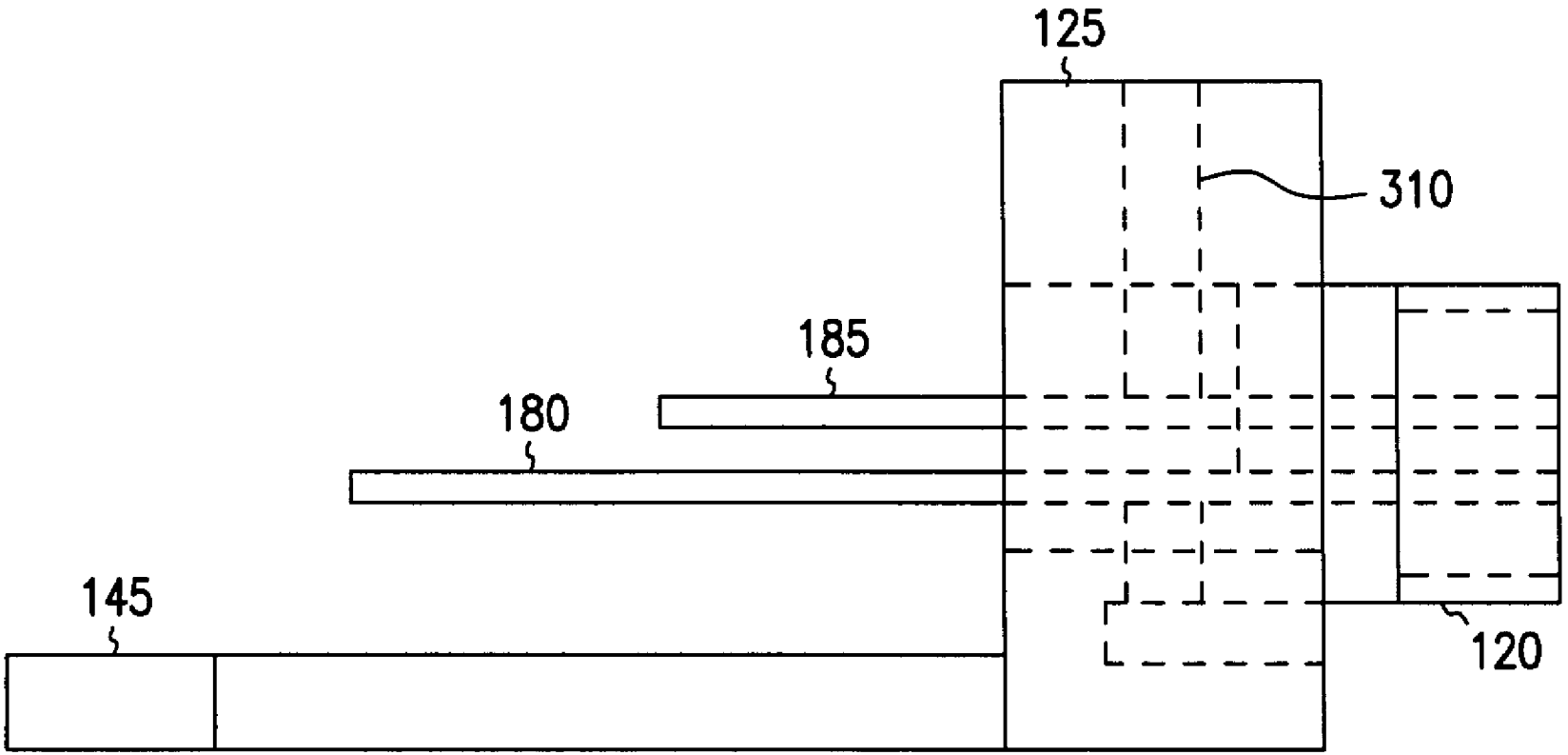
FIG. 6C illustrates a side view of a portion of one embodiment of the present system.

FIG. 6A, B and C illustrate another embodiment of the system of FIG. 5. In the figures, connector housing 110B includes a metal housing having walls and a bottom surface. Housing connector lid 110A is fastened to housing 110B. Lid 110A is fastened to housing 110B by means of threaded fasteners, rivets, drive screws or other means.

In one embodiment, shell holder 125 is depicted as a two-part assembly including shell holder 125A and shell holder 125B. Shell holder 125B includes a cavity shaped to receive connector 120, herein depicted as including the MICRO-PAX® shell. Shell holder 125A includes a cover plate to secure shell 120 within holder 125B. Shell holder 125A and shell holder 125B each include two holes 310 for accepting threaded fasteners. In one embodiment, connector 120 is sandwiched between shell holder 125A and 125B using two machine screws and two nuts.

FIG. 7 illustrates another embodiment of the present system. FIG. 7A shows a connector housing lid 110A having cable orifice 170 and mating face 115. Lid 110A is of cast aluminum construction having raised webs, or ridges as indicated at items 320 and thickened sections as indicated at 325. In addition to providing structural reinforcement and strength, the ridges and thickened sections, in conjunction with the walls of housing 10B (FIG. 7B), provide an improved EMI seal. Also visible in FIG. 7A are cable sealing members 330. Cable sealing members 330 are further described with respect to FIG. 9 and are captivated by the webs and thickened sections of lid 110A.

Figure 7C:
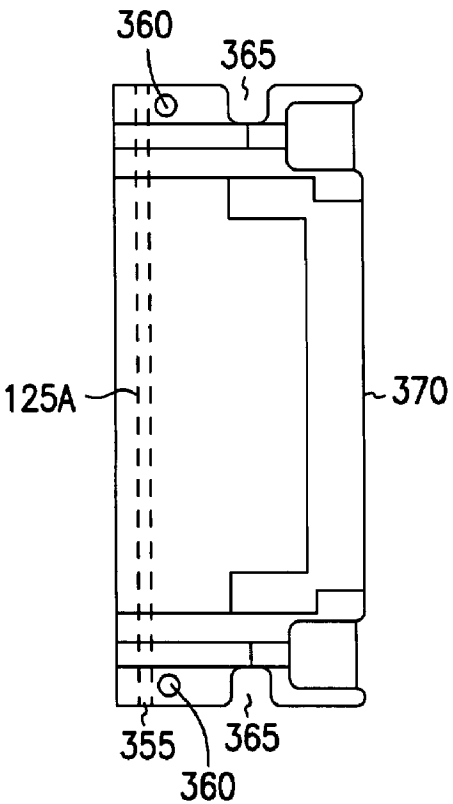
FIGS. 7A, 7B, 7C and 7D illustrate portions of one embodiment of the present system.
Figure 7A:
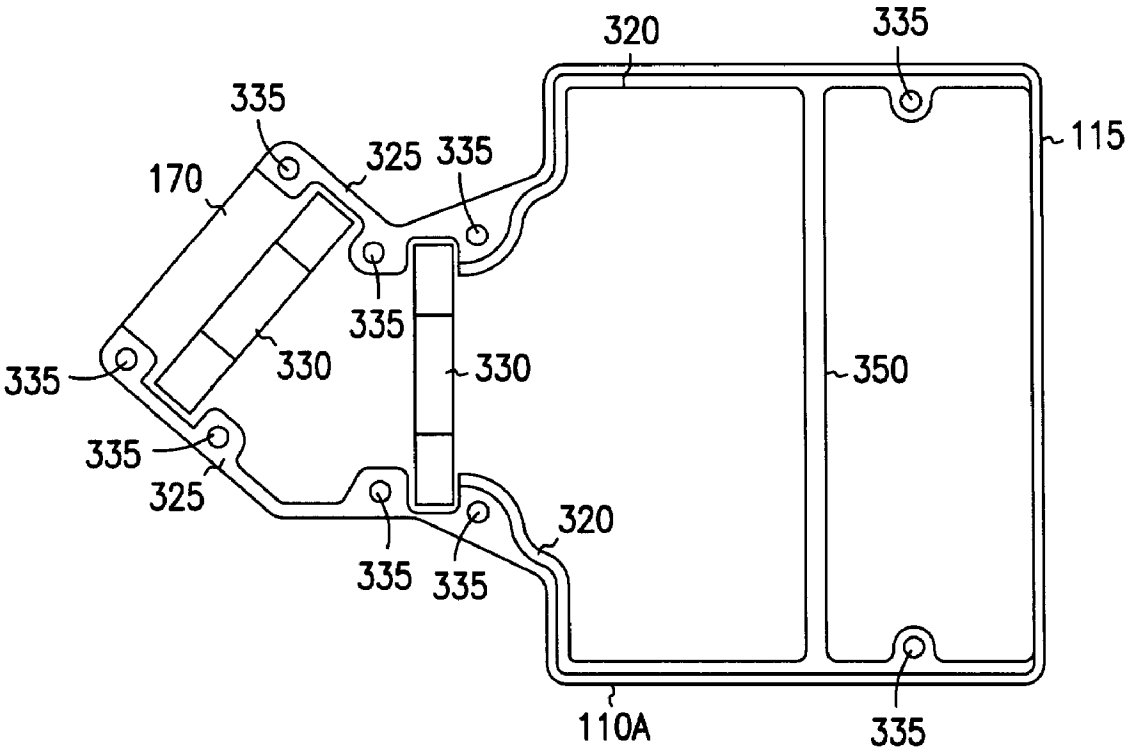
Figure 7D:
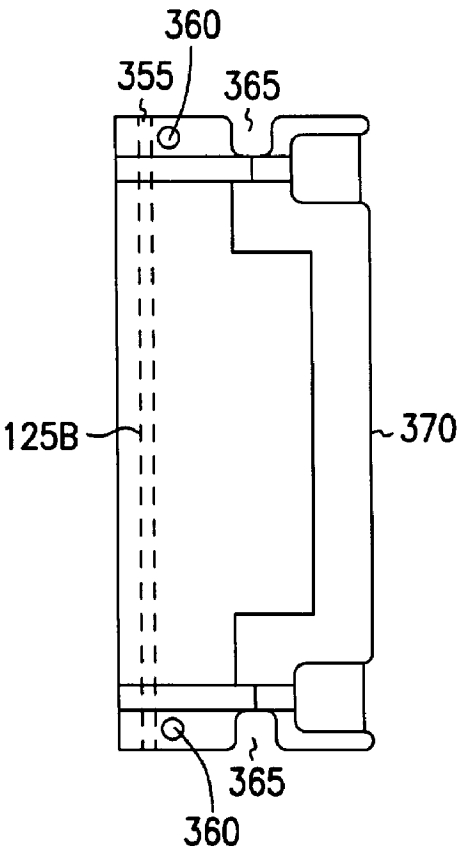
Figure 7B:
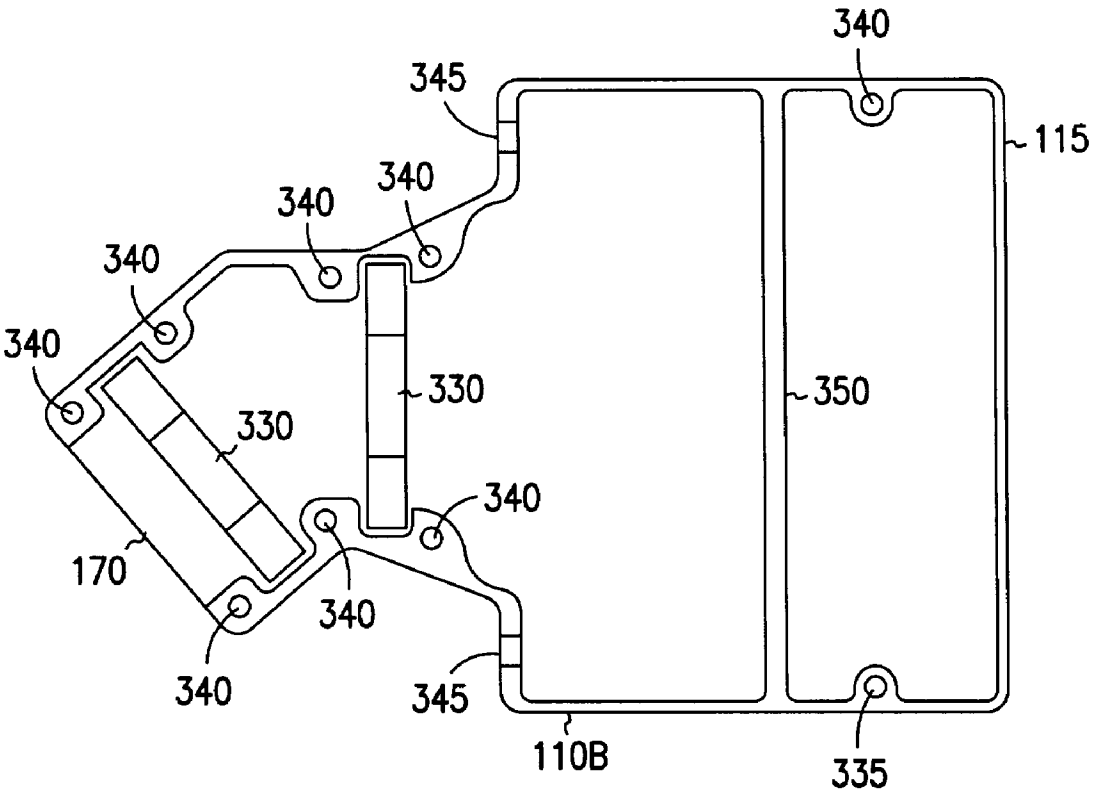
Figure 8A:
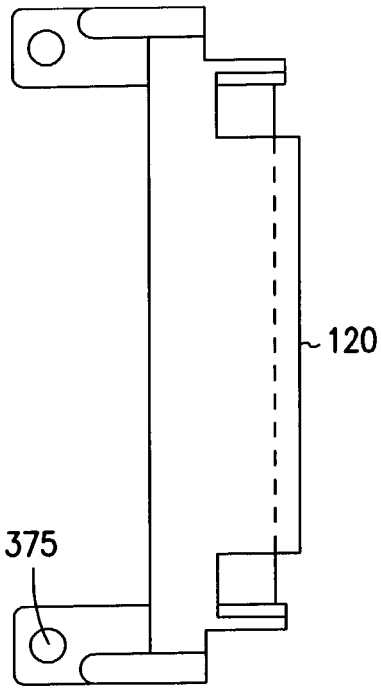
FIGS. 8A, 8B, 8C and 8D illustrate different views of a connector shell suitable for use with the present system.
Figure 8D:
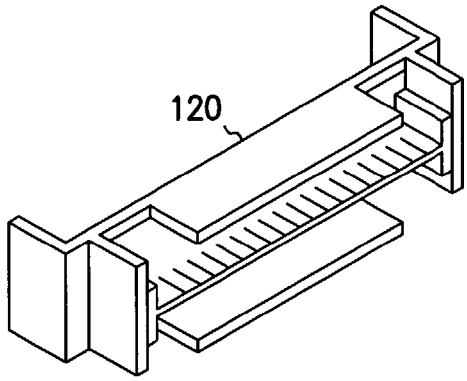
Figure 8B:
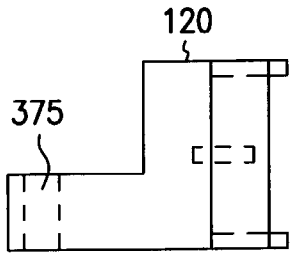
Figure 8C:
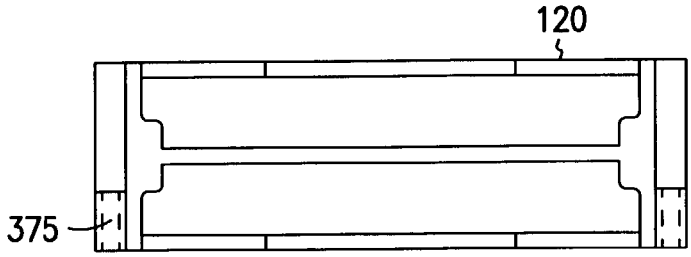

FIG. 7B illustrates housing 110B having cable orifice 170 and mating face 115. Housing 110B has wall sections including a plurality of threaded holes 340 for attachment of lid 110A using machine screws. Holes 345 are clearance holes for the shaft of jackscrew 230. Cable sealing members 330 are captivated by the walls of housing 110B.

In both FIG. 7A and FIG. 7B, ridge 350 is aligned transverse with respect to the longitudinal axis. Ridge 350 provides reinforcement and prevents substantial movement of the connector 120. Connector 120, and shell holder 125A and 125B are held securely relative to lid 110A and housing 110B.

Connector shell holder sections 125A and 125B are illustrated in FIGS. 7C and 7D, respectively. Sections 125A and 125B are adapted to fit within lid 110A and housing 110B, respectively. Alignment groove 355, visible as hidden lines in each of sections 125A and 125B, mates with ridge 350 in lid 110A and housing 110B. Holes 360 accept mechanical fasteners for securing connector 120 in the assembled shell holder sections 125A and 125B. Shell holder sections 125A and 125B are adapted to accept connector 120 in recess 370. Clearance for the wall section near the two forward holes 340 in housing 110B and lid 110A are provided by notches 365.

FIG. 8 illustrates one embodiment of connector 120, including a shell, suitable for use with the present system. FIGS. 8A, 8B and 8C depict top view, end view and forward view, respectively of connector shell 120. FIG. 8D depicts an isometric view of connector shell 120. Shell 120 includes a pair of mounting holes 375 for securing connector shell 120 to shell holder 125. In one embodiment, connector shell 120 is fabricated of cast, or machined, metal. In one embodiment, connector shell 120 is available from Berg Technology, Inc., One East First Street Reno Nev. 89501 and is known in the trade as a MICROPAX® connector shell.

Figure 9A:
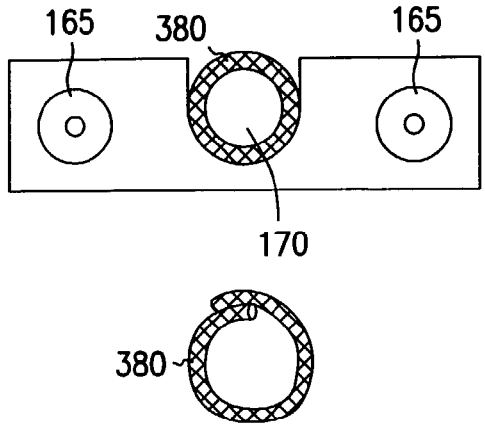
FIGS. 9A, 9B and 9C illustrate various electromagnetic interference Bonding mechanisms for cable shielding.
Figure 9B:
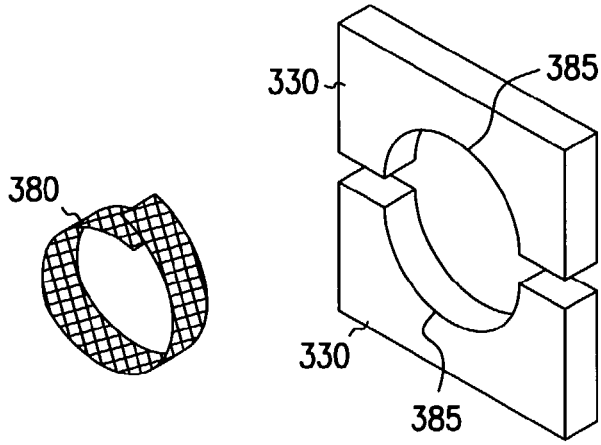
Figure 9C:
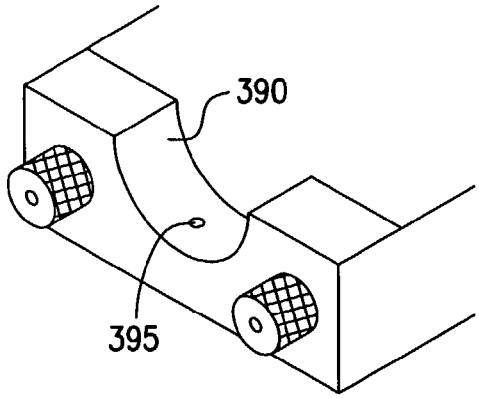

FIG. 9 illustrates one embodiment of cable sealing means. FIG. 9A provides a forward view of the backshell assembly, as viewed from the rear. Visible in the figure are jackscrew heads 165. Also visible is cable orifice 170. In one embodiment, housing 110 includes a sealing surface 395. In one embodiment, the sealing surface 395 is lined with cable sealing, or packing material 380. Cable packing material 380 may be a woven or non-woven conductive metal material in the form of a coiled strip. A rivet may be used to secure the cable packing material 380 to sealing surface 395.

In FIG. 9B, cable sealing members 330 are illustrated, each having semicircle 385. Sealing members 330 are fabricated of conductive metal and are adapted to fit securely in the webs and thickened sections of lid 110A and housing 110B of FIGS. 7A and 7B, respectively. Sealing material 380 is a woven or non-woven conductive metal material in the form of a coiled strip.

Alternative embodiments are also contemplated for the present subject matter. For example, in one embodiment, the electrical connector is securely fixed in position relative to the conductive housing. In one embodiment, the spacing between the electrical connector (and signal carrying components) relative to the conductive housing (or shield) is maximized.

In one embodiment, the impedance between shielding components is reduced to a minimum for radio frequency (RF) currents. Impedance reduction, in one embodiment, is provided by independent movement of the inner electrical connector (under the compression spring force) and the outside shielding case (forced against the mating surface with the threaded screw).

In one embodiment, an elastic member resists relative movement between the electrical connector and the housing. The elastic member exerts a force along an axis of the electrical connector.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention.

What is claimed is:

1. A device comprising:

an electrical connector having a plurality of electrical conductors adapted to mate with a matching connector;

an insulative shell encasing a portion of the electrical connector, a housing having an interior adapted to receive the electrical connector, the housing having a channel adapted to permit independent movement of the electrical connector relative to the housing, the housing including an electrically conductive material; and a threaded fastener coupled to the housing and adapted to mate with a corresponding fastener of the matching connector.

2. The device of claim 1 wherein the electrical connector is slidably coupled to the shell.

3. The device of claim 1 wherein the shell is slidably coupled to the housing.

4. The device of claim 1 wherein the housing includes a way aligned substantially parallel with a longitudinal axis of the electrical connector.

5. The device of claim 1 further comprising a spring coupled to the housing and coupled to the electrical connector wherein the spring opposes movement of the connector relative to movement of the housing.

6. A system comprising:

an electrical connector having a plurality of electrical conductors, the electrical connector having an electrically conductive shell;

an insulative separator surrounding a portion of the electrical connector;

an electrically conductive housing enclosing the insulative separator, the housing electrically isolated from the electrically conductive shell and having a guide to engage the insulative separator and to allow independent movement of the electrical connector and the housing along an axis; and an elastic member coupled to the housing, the elastic member adapted to resist independent movement of the electrical connector and the housing along the axis.

7. The system of claim 6 wherein the elastic member includes a coil spring.

8. The system of claim 6 wherein the elastic member includes a first coil spring and a second coil spring.

9. The system of claim 6 further including a clamping screw coupled to the housing and adapted to mate with a matching connector.

10. The system of claim 6 wherein the separator includes a polymer.

11. The system of claim 6 wherein the separator includes a plastic.

12. The system of claim 6 wherein the separator includes DELRIN® or TEFLON®.

13. The system of claim 6 further including at least one electrically conductive cable clamp disposed within the housing and proximate a cable end, the at least one electrically conductive cable clamp adapted for coupling with a shield of a cable.

14. The system of claim 6 wherein the elastic member is coupled to the electrical connector.

15. The system of claim 6 wherein the elastic member is coupled to the insulative separator.

16. A method comprising:

urging an outer housing of an electrical connector assembly in a forward direction;

displacing an inner housing of the electrical connector assembly in a rearward direction;

deflecting a spring between the outer housing and the inner housing; and engaging a threaded fastener between the outer housing and a matching connector.

17. The method of claim 16 wherein deflecting the spring includes compressing the spring.

18. The method of claim 16 wherein engaging the threaded fastener includes rotating the threaded fastener.

19. The method of claim 16 wherein urging the outer housing includes establishing an electrical connection.

20. The method of claim 16 wherein engaging the threaded fastener includes electrically bonding the outer housing with a shielding surface of the matching connector.

* * * * *